US005893282A

United States Patent [19]

Runge et al.

[11] Patent Number: 5,893,282

[45] Date of Patent: Apr. 13, 1999

[54] LOCKING DEVICE WITH EXCHANGEABLE LOCK INSERT

[75] Inventors: Friedhelm Runge, Wuppertal; Manfred Sauerland, Essen, both of Germany

[73] Assignee: EMKA Beschlagteile GmbH & Co. KG, Velbert, Germany

[21] Appl. No.: 08/732,403

[22] PCT Filed: Apr. 14, 1995

[86] PCT No.: PCT/DE95/00541

§ 371 Date: Dec. 18, 1996

§ 102(e) Date: Dec. 18, 1996

[87] PCT Pub. No.: WO95/29314

PCT Pub. Date: Nov. 2, 1995

[30] Foreign Application Priority Data

Apr. 20, 1994 [DE] Germany ..... 44 13 771

[51] Int. Cl.[6] ..... B60R 25/02

[52] U.S. Cl. ..... 70/208; 70/448; 70/367; 70/374

[58] Field of Search ..... 70/208, 276, 367, 70/370, 373, 374, 448–452; 292/336.3

[56] References Cited

U.S. PATENT DOCUMENTS

| | | | |
|---|---|---|---|
| 2,707,385 | 5/1955 | Fisler | 70/374 X |
| 3,768,284 | 10/1973 | Kent et al. | 70/448 X |
| 4,631,937 | 12/1986 | Debus et al. | 70/208 X |
| 5,233,851 | 8/1993 | Florian | 70/367 |
| 5,450,734 | 9/1995 | Esaki et al. | 70/208 |
| 5,564,294 | 10/1996 | Chen | 70/448 X |

FOREIGN PATENT DOCUMENTS

| | | | |
|---|---|---|---|
| 0054225 | 6/1982 | European Pat. Off. . | |
| 0261266 | 3/1988 | European Pat. Off. . | |
| 8406483 | 6/1984 | Germany . | |
| 3707313 | 9/1988 | Germany . | |
| 9012372 | 2/1992 | Germany . | |
| 4210588 | 10/1993 | Germany . | |
| 9406586 | 10/1994 | Germany . | |
| 679169 | 12/1991 | Switzerland | 70/448 |
| 2152577 | 8/1985 | United Kingdom . | |

OTHER PUBLICATIONS

Reversible IC cabinet lock switches to drawer lock; Jul. 1990; pp. 144–145; Locksmith Ledger International.

*Primary Examiner*—Suzanne Dino Barrett
*Attorney, Agent, or Firm*—Robert W. Becker & Associates

[57] ABSTRACT

A locking device for control cabinet doors has a plate with a depression attached to an outwardly facing side of a door leaf. The pivot lever is positioned in the depression. A projection is connected to a face of the plate facing the door leaf, the projection extending through a cutout of the door leaf past an inwardly facing side of the door leaf. A cap is connected to a free end of the projection, wherein the cap and the projection define a receiving chamber. A lock for locking the pivot lever when folded into the depression is provided. A housing matching the design and size of the lock is provided. The lock is enclosed and secured in the housing. The housing is exchangeably positioned in the receiving chamber. The plate has a receiving opening for providing access to the lock. The receiving opening has a periphery matching the shape of the housing. A forward edge of the housing, in a plane for receiving a key, at an inward side thereof has an inner contour matching the lock and at an outward side thereof has an outer contour matching the receiving opening.

7 Claims, 3 Drawing Sheets

LOCKING DEVICE WITH EXCHANGEABLE LOCK INSERT

BACKGROUND OF THE INVENTION

The invention relates to a locking device for control cabinet doors etc. with a plate having a depression to be placed onto the outwardly facing surface of the door leaf for receiving a pivot lever, wherein at least one projection, extending through a cutout in the door leaf and projecting past the door leaf plane inwardly is connected to the plate for receiving functional parts of the locking device, whereby the projection, closed off at the inner side with a cap, is designed to lock the pivot lever, when in a position folded into the depression, with a lock inserted into a coordinated opening of the locking device.

A locking device for control cabinet doors with the aforementioned features is disclosed in two different embodiments in European patent application 0 054 225 B1 and German patent application 42 10 588. One aspect of such locking devices is that the pivot lever in the position folded into the depression is locked with a lock therein so that an actuation of the locking device for unauthorized persons is not possible. In the embodiment disclosed in European patent application 0 054 225 a lock in the form of a profile cylinder lock is arranged in the pivot lever and, upon folding of the pivot lever into the depression, the lock enters the closed projection of the depression at the inner side of the door whereby the locking pawl provided at the profile cylinder lock, as is conventional, catches within an element that is provided at the projection of the depression, for example, in the form of a cutout or a projection etc. In the embodiment according to German patent application 42 10 588, the lock is stationarily arranged at the lower portion of the plate whereby the pivot lever is somewhat shorter and can be folded into an area of the depression above the lock whereby the lock cooperated with a separate locking member for the pivot lever which locking member either secures the pivot lever in its folded position or, upon actuation of the lock, releases it.

The known locking device in both embodiments has the disadvantage that the use of other types of locks as, for example, round cylinder or magnetic-card-operated locks is not easily possible without adapting the pivot lever and/or the depression in order to match the lock type. Since the aforementioned parts are conventionally made of plastic, considerable tool changes may be required in individual cases. Furthermore, the user of the locking device thus has no flexibility with respect to the lock since manufacture of the locking device already predetermines type and function of the respective lock.

It is therefore an object of the invention to improve a locking device of the aforementioned kind such that an exchange of the respectively employed lock is possible without requiring changes at the plate and the pivot lever.

SUMMARY OF THE INVENTION

The locking device for control cabinet doors according to the present invention is primarily characterized by:

- a plate with a depression attached to an outwardly facing side of a door leaf;
- a pivot lever positioned in the depression;
- a projection connected to a face of the plate facing the door leaf, the projection extending through a cutout of the door leaf past an inwardly facing side of the door leaf;

- a cap connected to a free end of the projection, wherein the cap and the projection define a receiving chamber;
- a lock for locking the pivot lever when folded into the depression;
- a housing matching a design and size of the lock;
- the lock enclosed and secured in the housing;
- the housing exchangeably positioned in the receiving chamber;
- the plate having a receiving opening for providing access to the lock;
- the receiving opening having a periphery matching a shape of the housing;
- wherein a forward edge of the housing, in a plane for receiving a key, at an inward side thereof has an inner contour matching the lock and at an outward side thereof has an outer contour matching the receiving opening.

The locking device may further comprise an actuating device for a separate locking member, the actuating device positioned within the housing and activated by the lock.

The lock is a profile cylinder with a laterally pivotable locking pawl.

The cap has detachable sidewalls and one of the sidewalls has an outwardly curved portion providing space for a pivoting movement of the locking pawl.

The lock preferably has a round cylindrical shape.

The lock may be a magnetic card-operated lock.

The lock may be in the form of a closing cylinder having an axially projecting follower.

The projection and the housing expediently have matching shapes projection.

The invention in its basic idea suggests that a housing adapted in its design and function to the lock and receiving the lock can be arranged exchangeably within the locking device and can be introduced into the projection of the plate functioning as a receiving chamber whereby the forward edge of the housing in the plane of insertion of the key for the lock at its inner side forms the contour of the lock and its outer side corresponds to the standardized opening of the locking device. With the invention it is thus advantageously provided that for an unchanged plate and unchanged pivot lever only by exchanging the housing arranged within the locking device a different type of lock can be used or retrofitted by removing the housing with the lock contained therein from the locking device and by replacing it with a different housing and a coordinated lock. Since the housing in the area of its forward edge determines the opening for receiving the lock, respectively, has an opening adapted to the type of lock, it is possible to provide the locking device, including the plate and pivot lever, with a predetermined opening for receiving the lock so that retrofitting, respectively, a different embodiment of the locking device does not require changing the plate and/or pivot lever.

Inasmuch as an embodiment of the locking device according to European patent application 0 054 225 B1 is concerned, the invention is applied such that the pivot lever comprises the standardized opening for receiving the housing with the lock and the housing is exchangeably connected to the pivot lever. Thus, the housing with the enclosed lock is to be integrated into the standardized opening at the pivot lever without requiring a change at the pivot lever. The housing is designed such that it can be introduced into the projection for which purpose within the projection optionally a locking possibility may be provided.

Inasmuch as a locking device according German patent application 42 10 588 A1 is concerned, the invention is concerned with the plate in the area of the projection providing a standardized opening for receiving the housing with the lock enclosed therein and the housing is exchangeably attachable to the projection at the inner side of the door. In this embodiment adaptations are also not required because the projection with cap is of a standardized design and only the housing with the enclosed lock at the plate must be exchanged. It may be expedient, depending on the type of the cylinder lock, to provide within the housing a separate locking member that is activated by actuation of the lock.

In the various alternative embodiments of the invention, the lock may be a profile cylinder with a laterally pivotable locking pawl, or a round cylinder or a magnetic-card-operated lock or a locking cylinder with an axially projecting follower at its actuation end; other previously not mentioned types of locks can also be used.

According to one embodiment it is suggested that the projection and the housing to be received therein for receiving the lock are provided with a matching positive-locking design for an oriented insertion of the housing into the projection. With this measure, an imprecise alignment of the housing within the projection as well as a displacement of the housing within the projection, for example, upon shaking loads acting on the locking device, are prevented.

BRIEF DESCRIPTION OF THE DRAWINGS

In the drawings embodiments of the invention are represented which will be explained in the following. It is shown in.

DESCRIPTION OF PREFERRED EMBODIMENTS

Figure 1:
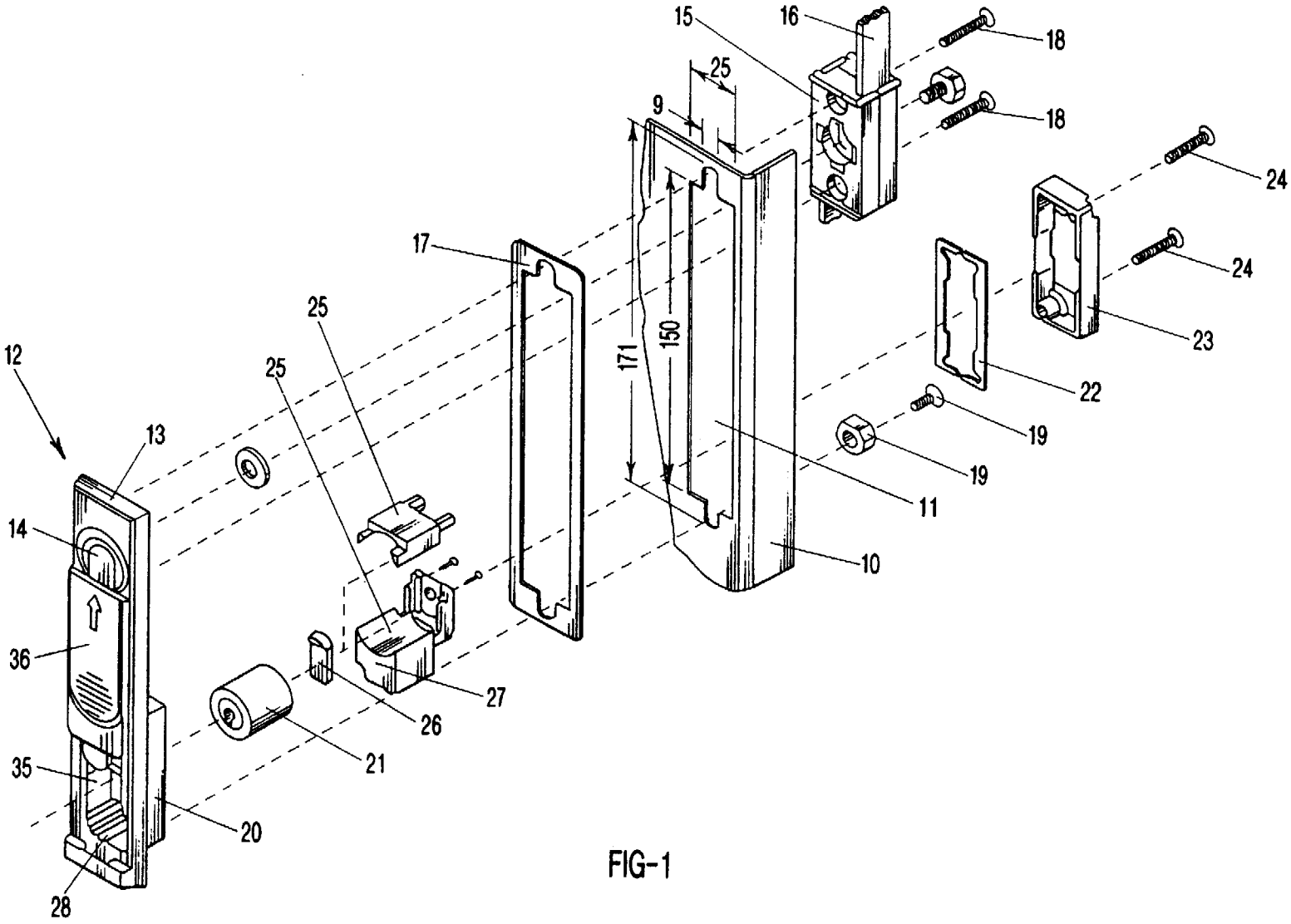
FIG. 1 a locking device with its essential components in an exploded representation with lock and enclosing housing.

The embodiments represented in the drawings show only the embodiment of one locking device as disclosed in German patent application 42 10 588. It is understood that the features explained in the following can also be used in connection with the design of the locking device as disclosed in European patent application 0 054 225 B1.

A control cabinet door 10 comprises in the shown embodiment an elongate cutout 11 for arranging and aligning a locking device 12 therein. The locking device 12 is comprised of a plate with depression 13 to be placed onto the exterior side of the control cabinet door 10 into which depression 13 a pivot lever 14 is folded. For actuating the locking device, the pivot lever 14 can be folded out of the depression 13 and is connected via a non-represented actuating shaft with a gear unit 15 penetrating the cutout 11 and cooperating with locking rods 16 running within the gear unit 15 that are displaced upon rotation of the pivot lever 14. Thus, a pivoting of the pivot lever 14 results in a displacement of the locking rods 16. For fastening the locking device 12 to the control cabinet door 10, the gear unit 15 is screwed threaded with fastening screws 18 to the depression plate 13 so that the gear unit 15 and the plate 13 are pulled against one another and clamp the control cabinet door 10 therebetween. In the lower area of the depression plate 13 a screw 19 fastens the plate 13 to the cabinet door 10.

For locking the pivot lever 14 in the depression plate 13, the depression plate 13 comprises a projection 20 extending through the cutout 11 of the cabinet door 10 and projecting past the inner side thereof for receiving a lock 21, whereby the projection 20 is closed off with interposition of a seal 22 at the inner side so that a receiving chamber for the lock 21 is provided. The cap 23 is connected with screws 24 to the projection 20.

In the embodiment represented in FIG. 1, the lock 21 is a round cylinder and the housing 25 matches the shape of the round cylinder. The housing can be introduced into the projection 20 and can be secured therein in an aligned manner. Based on the function of the round cylinder lock 21, an actuating member 26 is arranged within the housing 25 which is loaded by the round cylinder lock 21 and acts on the separate locking member within the projection 20 for locking, respectively, releasing the pivot lever 14 within the depression plate 13. The two-part housing 25 is connectable with corresponding fastening screws to the projection 20 whereby the forward edge 27 of the housing 25 at its inner side surrounds the contour of the round cylinder lock 21 and at its outer side matches the opening 35 within the depression plate 13. The additional positive-locking embodiment 28 within the projection 20 and at the housing 25 provides for a secured alignment of the housing 25 within the projection 20.

Figure 2:
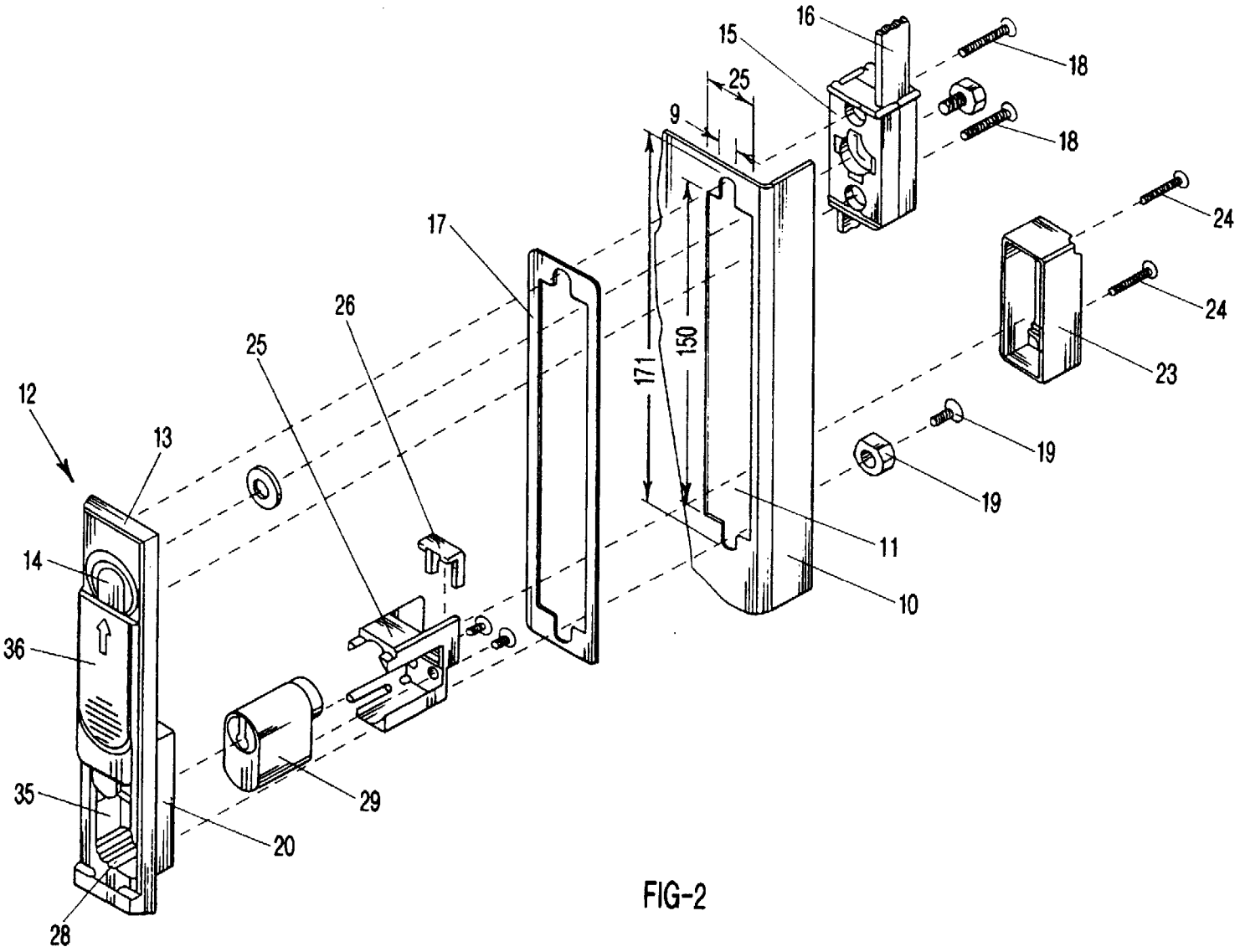
FIG. 2 another embodiment of the locking device of FIG. 1 with a different type of lock.

When it is desired to replace the round cylinder lock 21, shown in the embodiment of FIG. 1, with a lock of a different kind, then it is only required, as can be seen in a comparison of FIGS. 1 and 2, to remove the housing 25 with the round cylinder lock 21 in FIG. 1 from the projection 20 and to introduce instead, corresponding to the disclosed embodiment of FIG. 2, a closing cylinder with an actuating end that has an axially projecting follower and a respectively matching housing 25 into the projection 20 of the depression plate 13 and to secure it thereat by screws. Otherwise, the components of the locking device 12 match one another without any further adaptation.

Figure 3:
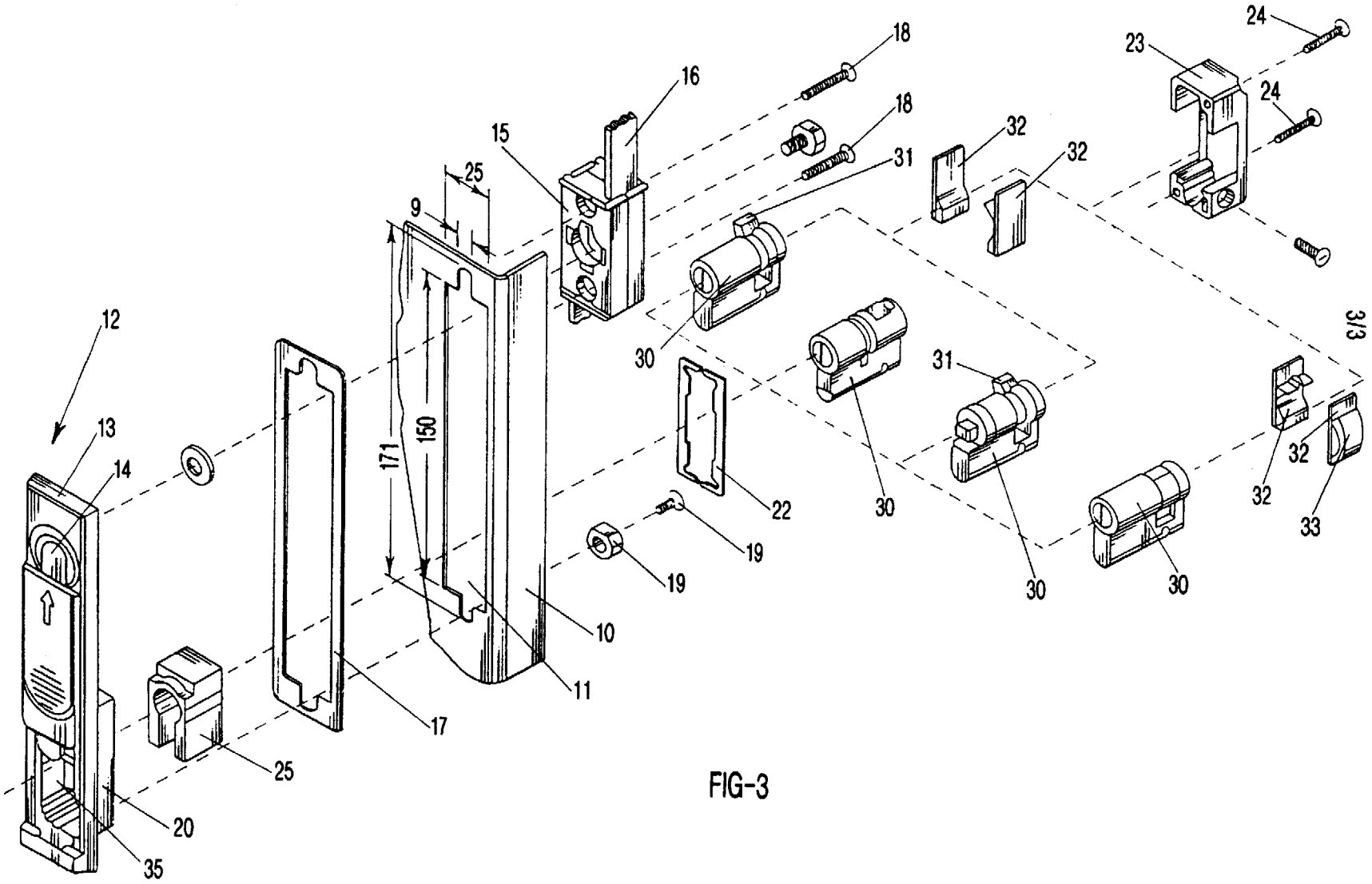
FIG. 3 a further embodiment of the locking device of FIG. 1 with yet another type of lock in different mounting variations of the lock.

FIG. 3 shows in detail the possibilities of using a lock in the form of a conventional profile semi-cylinder 30 whereby such profile semi cylinders 30 comprise a laterally pivotable locking pawl 31 for engagement of the separate locking member for the pivot lever 14. A housing 25, matching the shape of the profile semi cylinder 30, is insertable together with a corresponding profile semi cylinder into the projection 20 of the depression plate 13. From FIG. 3 different insertion variations of the profile semi cylinder 30 in a right, respectively, left arrangement for the locking pawl 31 can be taken, and it is additionally suggested that the sidewall 32 of the cap 23 comprises an outwardly curved portion 33 for allowing movement of the locking pawl 31. For this purpose, the sidewalls 32 are detachable from the cap 23 and thus also exchangeable, as is disclosed in principle already in German patent application 42 10 588 A1.

It is understood that a magnetic-card-operated lock can also be used with the correspondingly adapted housing to be inserted into the projection 20 of the depression plate 13.

As already disclosed in German patent application 42 10 588 A1, a sliding cover 36 is displaceably arranged at the depression plate 13, respectively, the pivot lever 14 with which the end face of the lock inserted therein can be covered within the depression plate 13.

It is furthermore understood that such a housing 25 with enclosed lock, in an embodiment adapted to the disclosure of European patent application 0 054 225, can be aligned and secured in an opening provided at the pivot lever 14, corresponding to opening 35 in the shown embodiment.

The features of the inventive object of this application disclosed in the above description, the claims, the abstract and the drawing may be important individually as well as in any desired combination for the realization of the invention in its various embodiments.

What we claim is:

1. A lock system for control cabinet doors, said lock system comprising:

a plate with a depression attached to an outwardly facing side of a door leaf;

a pivot lever positioned in said depression;

a projection connected to a face of said plate facing the door leaf, said projection extending through a cutout of the door leaf past an inwardly facing side of the door leaf;

a cap connected to a free end of said projection, wherein said cap and said projection define a receiving chamber;

a plurality of locks of different shapes and sizes;

a plurality of different housings, each one of said housings matching one of said locks;

each one of said locks enclosed and secured in said matching housing to form an exchangeable mounting unit;

wherein one of said exchangeable mounting units is mounted in said receiving chamber for locking said pivot lever, when said pivot lever is folded into said depression, and is exchanged when a different one of said locks is to be used for locking said pivot lever;

said plate having a receiving opening for providing access to said lock;

said receiving opening having a peripheral contour;

wherein each one of said housings has a forward edge in a plane for receiving a key, wherein said forward edge at an inward side thereof has an inner contour matching said lock;

wherein all of said housings have an identical outer contour of said forward edge matching said peripheral contour of said receiving opening;

wherein one of said housings includes an actuating device for a separate locking member, said actuating device positioned within said one housing and activated by said lock mounted in said one housing.

2. A locking device according to claim 1, wherein said lock is a profile cylinder with a laterally pivotable locking pawl.

3. A locking device according to claim 2, wherein said cap has detachable sidewalls and wherein one of said sidewalls has an outwardly curved portion providing space for a pivoting movement of said locking pawl.

4. A locking device according to claim 1, wherein said lock has a round cylindrical shape.

5. A locking device according to claim 1, wherein said lock is a magnetic card-operated lock.

6. A locking device according to claim 1, wherein said lock is a closing cylinder having an axially projecting follower.

7. A locking device according to claim 1, wherein said projection and said housing have matching shapes so that said housing is introduced in a predetermined orientation into said projection.

* * * * *